United States Patent [19]

VerMehren

[11] Patent Number: 4,514,182

[45] Date of Patent: Apr. 30, 1985

[54] METHOD OF AFFIXING ENVELOPES AND LETTERHEADS TO A CARRIER SHEET AND ASSEMBLY FORMED THEREBY

[76] Inventor: H. Richard VerMehren, 1395 Yaqui Dr., Florissant, Mo. 63031

[21] Appl. No.: 449,519

[22] Filed: Dec. 13, 1982

[51] Int. Cl.[3] ..... B31B 1/90

[52] U.S. Cl. ..... 493/216; 53/460; 229/69; 282/11.5 A; 282/25; 493/262; 493/380; 493/413; 493/921; 156/297

[58] Field of Search ..... 53/206, 460; 229/69, 229/73; 156/297, 552; 282/11.5 A, 25; 400/522, 531, 622, 626; 493/216, 220, 262, 380, 411, 413, 921

[56] References Cited

U.S. PATENT DOCUMENTS

| | | | |
|---|---|---|---|
| 2,226,574 | 12/1940 | O'Brien | 282/11.5 A |
| 3,237,970 | 3/1966 | Mudd | 282/11.5 A |
| 3,820,447 | 6/1974 | Gendron | 282/11.5 A |
| 4,091,987 | 5/1978 | Cone | 229/69 |
| 4,270,967 | 6/1981 | Cone | 156/552 |
| 4,298,158 | 11/1981 | Hoppe | 229/69 |
| 4,335,845 | 6/1982 | Dierks | 229/69 |
| 4,454,980 | 6/1984 | Poehler | 493/216 |

FOREIGN PATENT DOCUMENTS

| | | | |
|---|---|---|---|
| 2430964 | 6/1975 | Fed. Rep. of Germany | 282/11.5 A |
| 602352 | 7/1978 | Switzerland | 400/622 |
| 2092067 | 8/1982 | United Kingdom | 282/25 |

*Primary Examiner*—John Sipos

*Attorney, Agent, or Firm*—Polster, Polster & Lucchesi

[57] ABSTRACT

Envelopes and letter sheets are mounted on a continuous carrier in such a manner that they alternate and are continuously shingled. The envelope flaps are first affixed to the carrier sheet, with the envelopes in an open position and with their flap folds adjacent and parallel to infolds between carrier sheet panels. The letter sheets are then affixed to the same panels, with the free end of each sheet extending across both an outfold and the next infold. When the carrier sheet is fanfolded, each envelope closes over the top margin of the following letter sheet, and the lower margin of each letter sheet extends across the upper margin of the following envelope.

8 Claims, 4 Drawing Figures

METHOD OF AFFIXING ENVELOPES AND LETTERHEADS TO A CARRIER SHEET AND ASSEMBLY FORMED THEREBY

BACKGROUND OF THE INVENTION

This invention relates to a method of affixing or "tipping on" envelopes and letter paper onto a fanfolded continuous carrier sheet, and the resulting assembly.

Word processing systems of various types have made it possible to produce documents at high speed. The term "word-processing systems" is used broadly herein, and includes such devices as memory typewriters and computers equipped with an output printer. To accommodate the speed of such systems, it is now common practice to mount documents to a continuous carrier sheet which may be run continuously through the word processor printer. The documents may be of various types, such as letterhead stationery, envelopes, multilayer snap sets, although generally documents of only a single type are used on a single carrier sheet. Mounting documents to a carrier sheet in such a way that the documents are easily removable from the sheet is known as affixing or "tipping on" the documents. Typically, the documents are held to the carrier sheet by spots or patterns of a strippable glue. The carrier sheet is conveniently fanfolded in a short form, such that the panels are substantially shorter than the documents. The documents are attached to alternate panels of the carrier, and all documents therefore face upward on the folded carrier sheet. A typical short form, fanfolded carrier with affixed documents is described in Cone, U.S. Pat. No. 4,091,987.

For the proper feeding of carrier-mounted documents, it is important that the documents be overlapped or shingled, so that the upper edge of each succeeding document lies under the lower edge of the previous document as they move through a word processor printer. As shown in U.S. Pat. No. 4,091,987, this arrangemnt requires that the total length of two adjacent panels be somewhat less than the length of the document. Mounting the documents at high speed in this fashion, however, is difficult. The complexity of the required machinery is exemplified by Cone, U.S. Pat. No. 4,270,967. In that patent documents of the same type (either letters or envelopes) are first overlapped, then fed in overlapped condition to a pre-glued carrier sheet.

For many applications, it would be desirable to supply a carrier sheet in which envelopes and letter sheets are positioned alternately on a carrier sheet. Such an arrangement would permit a letter and its envelope (or an envelope and its letter) to be printed sequentially, without the necessity of separately feeding two different carrier sheets through the word processor printer, and would greatly simplify matching letters to the proper envelope. The problem, and one solution to the problem, are set out in Dierks, U.S. Pat. No. 4,335,845. Dierks' solution to the problem of providing both letter sheets and envelopes on a standard fanfolded carrier sheet is to provide a unique envelope-letter sheet device which is attached to each panel of a fanfolded standard carrier. This solution has a number of drawbacks.

A similar approach has been utilized by Moore Business Forms, Inc. of 1205 N. Milwaukee Ave., Glenview, Illinois 60025 to affix pre-printed envelopes and letter sheets to a single panel of a standard carrier sheet. Each envelope is affixed on the same panel as a letterhead sheet, in a separate glueing operation. This approach has substantial advantages over Dierks' approach. For example, it allows the letter sheet to be preprinted or to be a multiple layer snap set.

Neither Dierks' system nor Moore Business Forms' system permits continuous overlapping of the documents. Envelopes overlap letter sheets, but letter sheets do not overlap the envelopes on succeeding carrier sheet panels.

SUMMARY OF THE INVENTION

One of the objects of this invention is to provide a method of mounting separate envelopes and letter sheets alternately on the same carrier sheet, with the envelopes and letter sheets continuously overlapped. In other words, each document is shingled over the succeeding document.

Another object is to provide such a method in which the envelopes and letter sheets may be of any desired standard form, such as preprinted or embossed letterhead stationery and envelopes.

Another object is to provide such a method in which the envelopes and letter sheets may be placed on the carrier sheet at high speed, without the necessity of overlapping them before mounting them on the carrier sheet.

Another object is to provide an article of manufacture comprising continuously shingled separate envelopes and letter sheets affixed alternately on a short form fanfolded carrier sheet.

Other objects will occur to those skilled in the art in light of the following description and accompanying drawings.

In accordance with one aspect of this invention, generally stated, a method is provided by which envelopes and letter sheets are mounted on a continuous carrier in such a manner that they alternate and are continuously shingled. The envelope closure flaps are first affixed to the carrier sheet, with the closure flaps in an open position and with the envelope flap folds adjacent and parallel to infolds between carrier sheet panels. The letter sheets are then affixed to the same panels, with the free end of each sheet extending across both an outfold and the next infold. The open envelopes do not overlap the spots on which the letter sheets are glued, and therefore the method does not require shingling of the envelopes and letter sheets before they are attached to the carrier sheet. When the carrier sheet is fanfolded, each envelope closes over the top margin of the following letter sheet, and the lower margin of each letter sheet extends across the upper margin of the following envelope.

This method allows for production of a novel carrier sheet system in which continuously shingled separate letter sheets and envelopes are affixed to a carrier sheet. The finished system includes a fanfolded carrier sheet, on alternate panels of which are attached both an envelope and a letter sheet. The closure flap of the envelope is affixed to the carrier sheet, and the envelope overlaps the upper edge of the letter sheet. The upper end of the letter is affixed to the carrier sheet, below the envelope, and the letter sheet extends beyond the edge of the panel to which it is mounted by a distance greater than the length of the succeeding panel of the carrier sheet. The letter sheet therefore overlaps the succeeding envelope when the carrier sheet is extended.

The invention is quite flexible in accommodating letter sheets and envelopes of various sizes, envelopes of varying designs, and letter sheets and envelopes with or without pre-printed or pre-embossed letterheads or designs. The size of the panels of the carrier sheet may also be varied easily, to accommodate different length letter sheets, for example.

If desired, the bodies of the envelopes may be glued down to aid refolding the carrier sheet after it has passed through a word processor printer.

Other aspects of the invention will best be understood in light of the following description of the preferred embodiment and the accompanying drawing.

DESCRIPTION OF THE PREFERRED EMBODIMENT

Figure 1:
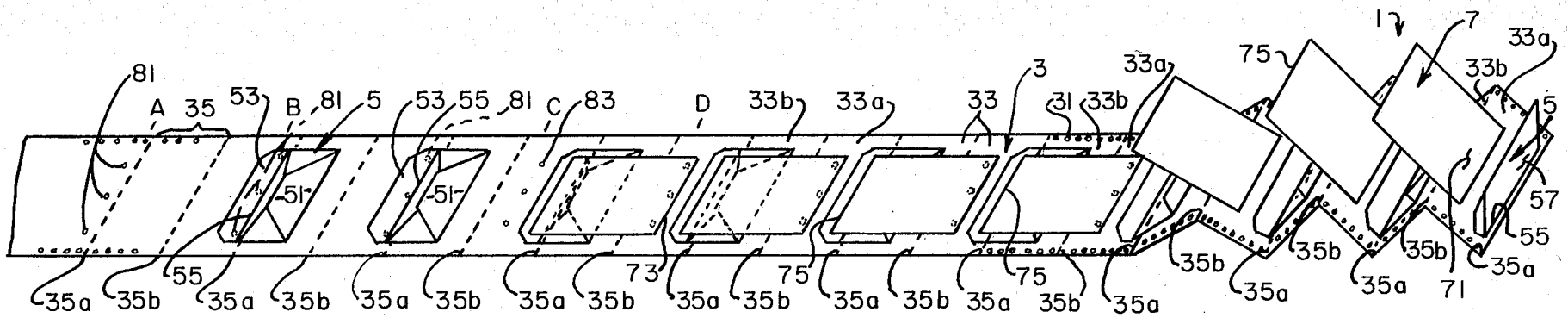
FIG. 1 is a view in perspective illustrating the process of the present invention.

Referring now to the drawing, and in particular to FIG. 1, reference numeral 1 indicates a carrier sheet system of the present invention. The carrier sheet system 1 is in the process of being formed by the method of the invention, with the steps of the invention being carried out from left to right in the drawing. The carrier sheet system 1 includes a carrier sheet 3, envelopes 5, and letter sheets 7.

The carrier sheet 3 is illustratively a standard paper carrier sheet having a width of 11¾". The carrier sheet 3 includes standard half-inch spaced line hole punchings 31 extending lengthwise of the carrier sheet 3 adjacent its edges, for engagement by a tractor feed device. The carrier sheet 3 is divided into panels 33 by transverse perforations 35. Each panel 33 is illustratively seven inches long. When fanfolded along the perforations 35, alternate perforations 35 are folded downwardly to form infolds **35*a* and upwardly to form outfolds 35*b*. As viewed in FIG. 1, panels 33*a* having an infold 35*a* as their leading edge may be designated upper panels, and panels 33*b* having an outfold 35*b*** as their leading edge may be designated lower panels.

The envelopes 5 are illustratively standard "No. 10" envelopes. The envelopes 5 include a body 51 of standard construction, a closure flap 53, and a closure fold 55. The body 51 is 9½" long and 4⅛" high. The closure flap 53 typically includes a pressure activated adhesive protected by a strippable tape or more commonly a moisture activated adhesive for sealing the envelope after the letter has been inserted in it. The closure fold 55 forms the upper edge of the envelope 5 when the flap 53 is closed. Illustratively, the envelopes 5 include a pre-printed return address 57.

The letter sheets 7 are illustratively standard letterhead stationery of a standard 8½" by 11" size. A letterhead 71 is pre-printed or embossed at the upper end of each letter sheet 7.

As shown at the left side of FIG. 1, in the method of the present invention the carrier sheet may be extended flat for processing.

In the first step, indicated at A, first glue spots 81 are applied to each upper panel **33*a*, spaced about one-quarter inch behind infold 35*a***. The glue may be any of the standard strippable glues which are well known in the art.

In the next step, indicated at B, envelopes 5 are placed on the carrier sheet 3. Each envelope 5 is positioned with its closure flap 53 opened, and the outside of the closure flap 53 is placed on the glue spots 81 on upper panel **33*a*. The closure fold 55 is positioned approximately 3/16" behind (i.e., on the upper panel side of) its associated infold 35*a* in the carrier sheet 3. The major part of the body 51 of the envelope is positioned over the preceding lower panel 35*a* (i.e., the panel to the right of it as viewed in FIG. 1**).

In the next step, indicated at C, second glue spots 83 are applied to each upper panel **33*a* at a position trailing the closure flap 53 attached to that panel. In this embodiment, the glue spots 83 trail the infold 35*a* by about 3¾". The glue spots 83 are preferably of the same glue as the spots 81**.

In the next step, indicated at D, letter sheets 7 are placed on the carrier sheet 3. Each letter sheet 7 is positioned with its letterhead 71 forward, and the upper (forward) edge 73 of the letter sheet is placed on the glue spots 83 on upper panel **33*a*. The upper (forward) edge 73 is positioned approximately 3 11/16" behind its associated infold 35*a* in the carrier sheet 3. The letter sheet 7 extends across the entire trailing lower panel 33*b* (i.e., across the trailing outfold 35*b* of the panel 33*a* to which it is affixed and across the trailing infold of the succeeding lower panel 33*b*). It will be seen that the letter sheet 7 overlaps the entire height of the body 51 and a portion of the closure flap 53 of the succeeding envelope 5. More precisely, the lower (trailing) edge 75 of the letter sheet 7 extends beyond (i.e., to the left of, as viewed in FIG. 1) the succeeding infold 35*a*** by 11/16" and extends beyond the infold of the succeeding envelope by ½".

In the final step of producing the carrier sheet system of the present invention, the envelopes 5 are closed by fanfolding the carrier sheet 3. This step is indicated generally at E. As the carrier sheet 3 is fanfolded, the letter sheets 7 are lifted from the lower panels **35*b*, and the envelopes 5 are folded along closure flap folds 55 by the adjacent infolds 35*a*. When the envelopes 5 have been closed, the envelopes 5 overlap the succeeding letter sheets 7, and the lower margins of the envelopes 5 extend ⅝" beyond the upper edges 73 of the letter sheets 7**.

It will be seen that the process of the present invention does not require lifting of one document to permit affixing of the forward edge of the succeeding document. Therefore, the process is amenable to be carried out by high speed equipment if desired.

Figure 3:
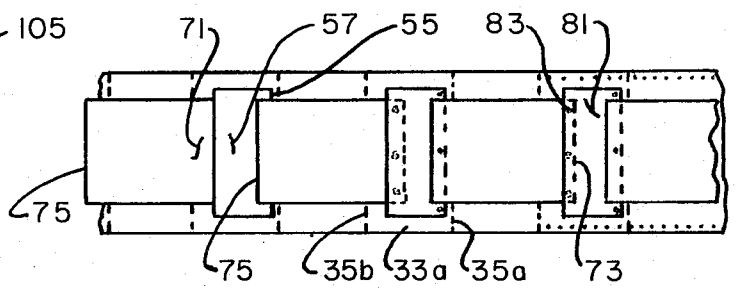
FIG. 3 is a top plan view of the carrier sheet system of FIG. 2, with the carrier sheet extended.
Figure 2:
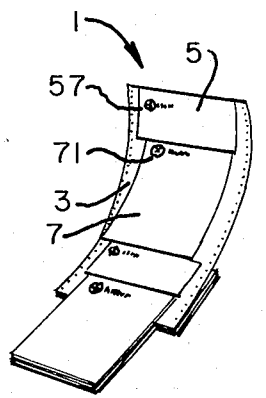
FIG. 2 is a view in perspective of a carrier sheet system of the present invention.

The resulting carrier sheet system 1 is shown in FIG. 2 in a folded form for transportation and storage, with the uppermost envelopes and letter sheet 7 extended. In FIG. 3 the system 1 is shown in an extended form, as might be the immediate input or output of a word processor printer.

As shown in FIG. 2, the carrier sheet system 1 includes the fanfolded carrier sheet 3, to which are affixed alternating envelopes 5 and letter sheets 7. Each envelope is closed, and the body of the envelope overlaps a letter sheet attached to the same panel of the carrier sheet. Each envelope is closed and the closure flap fold at the top of the envelope is adjacent and parallel to an infold in the carrier sheet. Each letter sheet extends beyond the lower margin of the panel to which it is attached, by a distance greater than the length of the succeeding panel of the carrier sheet. Therefore, when the carrier sheet is extended as shown in FIG. 3, the letter sheets overlap succeeding envelopes, so that the letter sheets and envelopes are continuously overlapped. Because of the method of producing the carrier sheet system of the invention, not only are the envelopes and letter sheets continuously overlapped, but each may overlap the glue spots of the succeeding document. Also because of the method of the present invention, the carrier sheet system may utilize a wide variety of letter sheets and envelopes, including pre-existing printed or embossed stationery.

Numerous variations in the carrier sheet method and system of the present invention, within the scope of the appended claims, will occur to those skilled in the art in light of the foregoing disclosure.

Merely by way of example, the letter sheet 7 may be a multiple layer snap set, with or without carbon paper. The positioning of the envelopes and letter sheets on each panel may be varied considerably. For example, the upper edge of the envelope 5 could be positioned about 2" below an infold 35*a*, and the letter sheet 7 could then be positioned about 5½" below the infold 35*a*. So long as the total length of succeeding panels 33*a* and 33*b* is less than the length of an overlapped envelope and letter sheet, the dimensions of the envelopes, letter sheets and carrier sheet panels may be substantially varied, as may the amount of overlap between documents.

Figure 4:
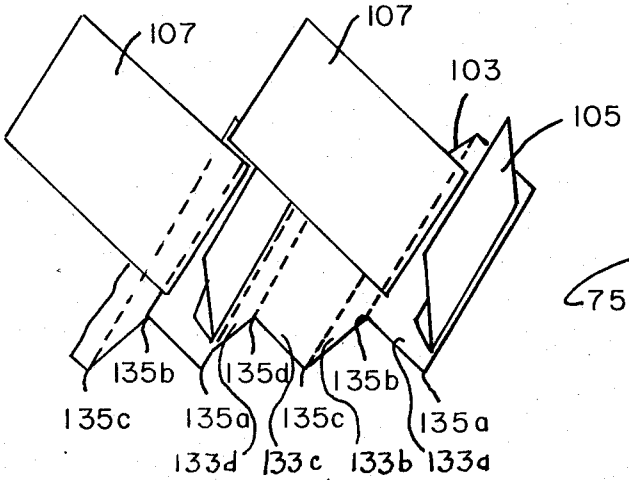
FIG. 4 is a view in perspective of a second embodiment of carrier sheet system of the present invention.

If desired, each of the panels 33A and 35*b* may be folded in half to form an extra-short form carrier system as shown in FIG. 4. It will be seen that all of the original folds 35 thus become infolds 135*a*. Each envelope 105 is then affixed immediately below an infold 135*a*, and each letter sheet 107 is affixed immediately above the succeeding outfold 135*b* on the "semi-panel" 133*a*. Three succeeding semi-panels 133*b*, 133*c* and 133*d* are left without attachment. This arrangement is bulkier than the preferred embodiment, but simplifies removal of the envelopes and letter sheets individually or as a set, because both extend beyond the carrier sheet when it is folded.

Additional glue spots may be applied to the documents or to the carrier sheet under the documents. For example, it may be highly advantageous to apply additional glue spots, at location A in FIG. 1, about two inches behind the glue spots 81 which hold the envelope flap 53. Complementary glue spots may simultaneously be applied to the back of the envelope 5. When the envelope 5 is closed, the complementary glue spots hold the envelope 5 to the carrier sheet 3. Therefore, the envelope remains closed as it passes through the word processor printer, and the carrier sheet is easily folded as it emerges from the word processor.

These variations are merely illustrative.

I claim:

1. A method for affixing envelopes and letter sheets to a continuous carrier, said envelopes comprising a body part and a closure flap connected to the body part along a closure flap fold, said carrier sheet comprising a plurality of panels fanfolded to form alternate upper and lower panels connected by alternate infolds and outfolds, said method comprising a step of affixing a quantity of envelope flaps to a plurality of said panels of said carrier sheet, a step of affixing a plurality of letter sheets to the same plurality of said panels and to the same side of said panels to which said envelopes are affixed, said envelope closure flaps being in open positions and said letter sheets being affixed to said panels at a position not covered by said envelope bodies, and a step of closing said envelopes without removing said envelopes from said carrier sheet by folding and turning said envelope bodies about said closure flap folds thereby overlapping said letter sheets when in said closed position.

2. The method of claim 1 wherein a first said envelope is affixed to a first said upper panel and a second envelope is affixed to a second upper panel of said carrier sheet, and thereafter a first said letter sheet is affixed to said first upper panel of said carrier sheet, said first letter sheet extending above the body of said second envelope, and thereafter closing said first envelope and said second envelope.

3. The method of claim 2 wherein each of said first and second envelopes is affixed to said carrier sheet with its said closure flap fold adjacent and parallel to an infold between carrier sheet panels.

4. The method of claim 3 wherein said step of closing said first envelope and said second envelope comprises a step of fanfolding said carrier sheet after said letter sheet is affixed to said carrier sheet.

5. The method of claim 2 wherein said second upper panel is separated from said first upper panel by only a single lower panel.

6. The method of claim 2 wherein each of said panels is shorter than either said envelopes or said letter sheet, and wherein said letter sheet extends a distance beyond the panel to which it is affixed by a distance greater than the length of three succeeding panels, said second envelope being affixed to a panel separated from said first panel by three intervening panels.

7. A method for affixing envelopes and letter sheets to a continuous carrier sheet having a plurality of panels in such a manner that the envelopes and letter sheets alternate and are continuously shingled, each of said envelopes comprising a body part and a closure flap connected to the body part along a closure flap fold, said method comprising a step of affixing envelope flaps and letter sheets to the same specific panels of the carrier sheet and on the same side of said carrier sheet so that said letter sheets are affixed to said panels at a position not covered by said envelope bodies, with said envelopes in an open position, and a step of closing said envelopes without removing said envelopes from said carrier sheet by folding and turning said envelope bodies about said closure flap folds thereby overlapping said letter sheets when in said closed position.

8. The method of claim 7 wherein said carrier sheet comprises a plurality of panels fanfolded to form alternate upper and lower panels connected by alternate infolds and outfolds, and wherein said first step of said method comprises affixing envelope flaps to one of said upper panels of said carrier sheet and letter sheets to the same upper panels of said carrier sheet, with said closure flap folds of said envelopes adjacent and parallel to an infold between carrier sheet panels.

* * * * *